US011423728B2

(12) United States Patent
Yoshimura et al.

(10) Patent No.: US 11,423,728 B2
(45) Date of Patent: Aug. 23, 2022

(54) BANKNOTE INSPECTION DEVICE, BANKNOTE INSPECTION METHOD, AND BANKNOTE INSPECTION PROGRAM PRODUCT

(71) Applicant: FUJITSU FRONTECH LIMITED, Tokyo (JP)

(72) Inventors: Kazuhisa Yoshimura, Inagi (JP); Akio Maruyama, Inagi (JP)

(73) Assignee: FUJITSU FRONTECH LIMITED, Tokyo (JP)

( * ) Notice: Subject to any disclaimer, the term of this patent is extended or adjusted under 35 U.S.C. 154(b) by 0 days.

(21) Appl. No.: 17/221,454

(22) Filed: Apr. 2, 2021

(65) Prior Publication Data

US 2021/0225112 A1 Jul. 22, 2021

Related U.S. Application Data

(63) Continuation of application No. PCT/JP2018/039565, filed on Oct. 24, 2018.

(51) Int. Cl.
*G07D 7/12* (2016.01)
*G07D 7/005* (2016.01)

(52) U.S. Cl.
CPC ..... *G07D 7/12* (2013.01); *G07D 7/005* (2017.05)

(58) Field of Classification Search
CPC ..... G07D 7/12; G07D 7/005; G07D 7/0054; G07D 7/185
See application file for complete search history.

(56) References Cited

U.S. PATENT DOCUMENTS

2002/0043560 A1* 4/2002 Woods ..... G07D 7/185 235/438

FOREIGN PATENT DOCUMENTS

| | | | |
|---|---|---|---|
| JP | 05054195 | A | 3/1993 |
| JP | 07160830 | A | 6/1995 |
| JP | 07220087 | A | 8/1995 |
| JP | 08329195 | A | 12/1996 |
| JP | 2009-545807 | A | 12/2009 |
| JP | 2013-020617 | A | 1/2013 |
| JP | 2017-215859 | A | 12/2017 |
| JP | 6294524 | B1 | 2/2018 |

OTHER PUBLICATIONS

International Search Report (Form PCT/ISA/210); dated Nov. 27, 2018 in corresponding PCT Application No. PCT/JP2018/039565 (3 pages) (1 page English Translation).

* cited by examiner

*Primary Examiner* — Christopher Wait
(74) *Attorney, Agent, or Firm* — Staas & Halsey LLP

(57) ABSTRACT

In a banknote inspection device, a storage unit stores a first learning model generated using an image of a character with a hole as training data, and a second learning model generated using an image of a character without a hole as training data, and a recognition unit recognizes a serial number character that is a character forming a serial number of a banknote by using the first learning model when a character image, which is as image of the serial number character, has a hole, and recognize the serial number character by using the second learning model when the character image does not have a hole.

16 Claims, 13 Drawing Sheets

FIG.8

X

Y

SNP

| | 1 | 2 | 3 | 4 | 5 | 6 |
|---|---|---|---|---|---|---|
| 1 | 220 | 220 | 220 | 220 | 140 | 140 |
| 2 | 210 | 210 | 210 | 210 | 130 | 130 |
| 3 | 200 | 200 | 200 | 200 | 120 | 120 |
| 4 | 220 | 220 | 220 | 220 | 140 | 140 |
| 5 | 220 | 220 | 220 | 220 | 140 | 140 |
| 6 | 210 | 210 | 210 | 210 | 130 | 130 |
| 7 | 210 | 210 | 210 | 210 | 130 | 130 |
| 8 | 200 | 200 | 200 | 200 | 120 | 120 |
| 9 | 200 | 200 | 200 | 200 | 120 | 120 |

FIG.9

X

Y

SNP

| | 1 | 2 | 3 | 4 | 5 | 6 |
|---|---|---|---|---|---|---|
| 1 | 255 | 255 | 255 | 255 | 0 | 0 |
| 2 | 255 | 255 | 255 | 255 | 0 | 0 |
| 3 | 0 | 0 | 0 | 0 | 0 | 0 |
| 4 | 255 | 255 | 255 | 255 | 0 | 0 |
| 5 | 255 | 255 | 255 | 255 | 0 | 0 |
| 6 | 255 | 255 | 255 | 255 | 0 | 0 |
| 7 | 255 | 255 | 255 | 255 | 0 | 0 |
| 8 | 0 | 0 | 0 | 0 | 0 | 0 |
| 9 | 0 | 0 | 0 | 0 | 0 | 0 |

BANKNOTE INSPECTION DEVICE, BANKNOTE INSPECTION METHOD, AND BANKNOTE INSPECTION PROGRAM PRODUCT

CROSS-REFERENCE TO RELATED APPLICATION

This application is a continuation of International Application No. PCT/2018/039565, filed on Oct. 24, 2018, the entire contents of which are incorporated herein by reference.

FIELD

The present disclosure relates to a banknote inspection device, a banknote inspection method, and a banknote inspection program product.

BACKGROUND

A banknote handling device such as an automated teller machine (ATM) is provided with a banknote inspection device that inspects banknotes to discriminate banknote denominations and recognize banknote serial numbers.

Example of related-art is described in Japanese Patent Application Laid-open No. 2017-215859.

Because banknotes can be uniquely identified using serial numbers, serial numbers are used to find counterfeit banknotes, and so forth. Accurate recognition of serial numbers is thus important.

SUMMARY

According to an aspect of an embodiment, a banknote inspection device includes a storage unit and a recognition unit. The storage unit stores a first learning model generated using an image of a character with a hole as training data, and a second learning model generated using an image of a character without a hole as training data. The recognition unit recognizes a serial number character that is a character forming a serial number of a banknote by using the first learning model when a character image, which is an image of the serial number character, has a hole, and recognize the serial number character by using the second learning model when the character image does not have a hole.

The object and advantages of the disclosure will be realized and attained by means of the elements and combinations particularly pointed out in the claims.

It is to be understood that both the foregoing general description and the following detailed description are exemplary and explanatory and are not restrictive of the disclosure, as claimed.

BRIEF DESCRIPTION OF DRAWINGS

FIG. 8 is a diagram used to illustrate an operation example of the serial number recognition unit according to the first embodiment.

FIG. 9 is a diagram used to illustrate an operation example of the serial number recognition unit according to the first embodiment.

DESCRIPTION OF EMBODIMENTS

Preferred embodiments of the present disclosure will be explained with reference to accompanying drawings. The following embodiments, however, are not intended to limit the technology of the present disclosure. In the following embodiments, identical constituent elements are denoted by identical reference signs.

First Embodiment

<Configuration of Banknote Handling Device>

Figure 1:
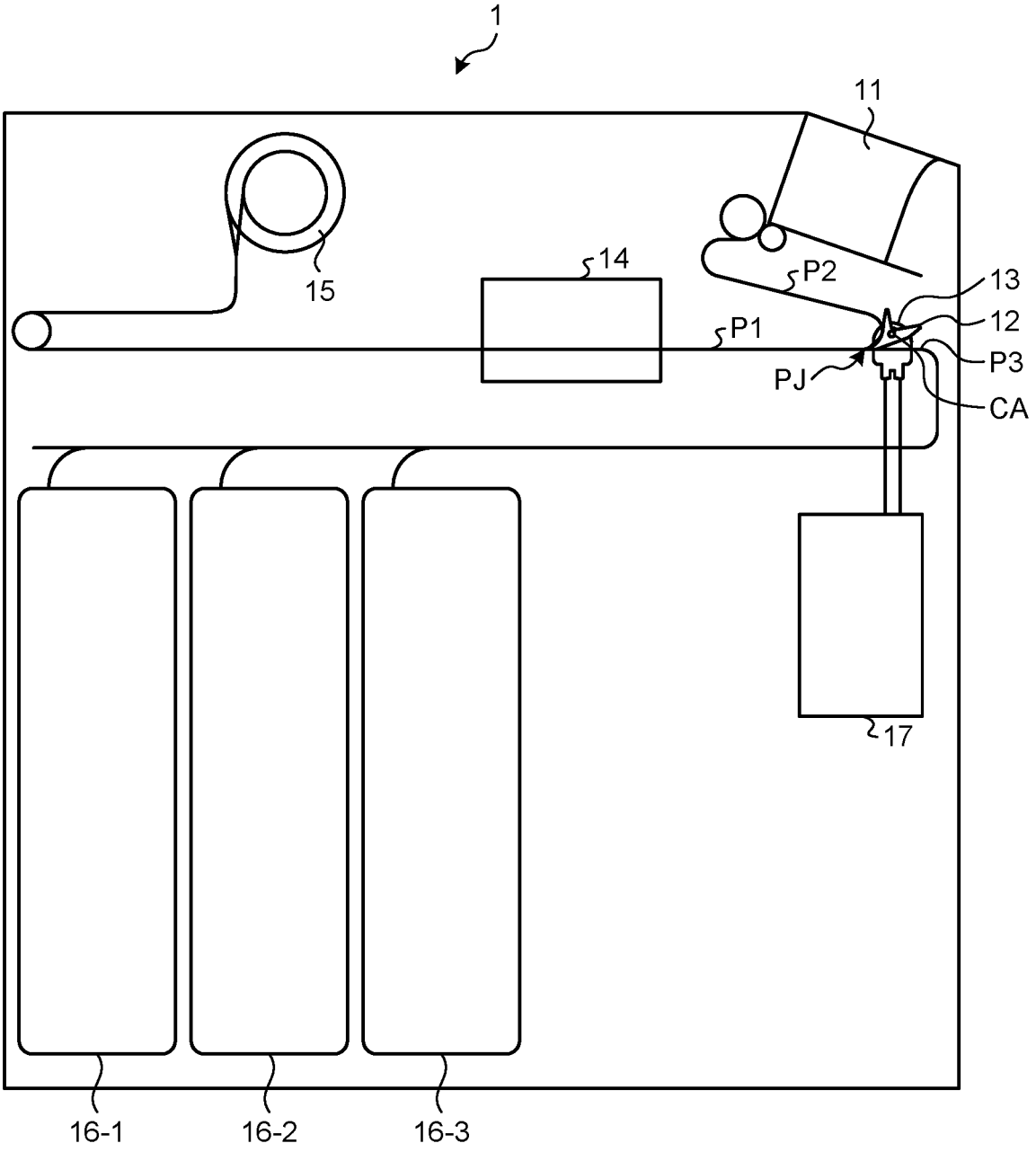
FIG. 1 is a view illustrating a configuration example of a banknote handling device according to a first embodiment.

FIG. 1 is a diagram illustrating a configuration example of a banknote handling device according to a first embodiment. FIG. 1 is a side cross-sectional view. In FIG. 1, a banknote handing device 1 has an access port 11, a switching claw 12, a solenoid 13, a banknote inspection device 14, a temporary holding part 15, stackers 16-1, 16-2, and 16-3, a control unit 17, and conveyance paths P1, P2, and P3.

Further, in a banknote handling device 1, there is a conveyance path branch point PJ at which a conveyance path P1 branches into two conveyance paths P2 and P3. In the banknote handling device 1, by connecting conveyance path P1 to either of conveyance paths P2 and P3 via the conveyance path branch point PJ, the conveyance path connection mode switches between a mode in which conveyance paths P1 and P2 are connected (sometimes referred to hereinbelow as "connection mode C1") and a mode in which conveyance paths P1 and P3 are connected (sometimes referred to hereinbelow as "connection mode C2"). When the conveyance path connection mode is in connection mode C1, a conveyance path in which conveyance paths P1 and P2 are sequential is formed, and when the conveyance path connection mode is in connection mode C2, a conveyance path in which conveyance paths P1 and P3 are sequential is formed.

A center axle CA of the switching claw 12 is connected to the solenoid 13, and the switching claw 12 can be rotated by the solenoid 13 about the center axle CA. The switching claw 12 and solenoid 13 are arranged close to the conveyance path branch point PJ, and the conveyance path connection mode is switched between connection mode C1 and connection mode C2 due to the switching claw 12 being rotated by the solenoid 13. The switching of the conveyance path connection mode is carried out under the control of the control unit 17.

Figure 2:
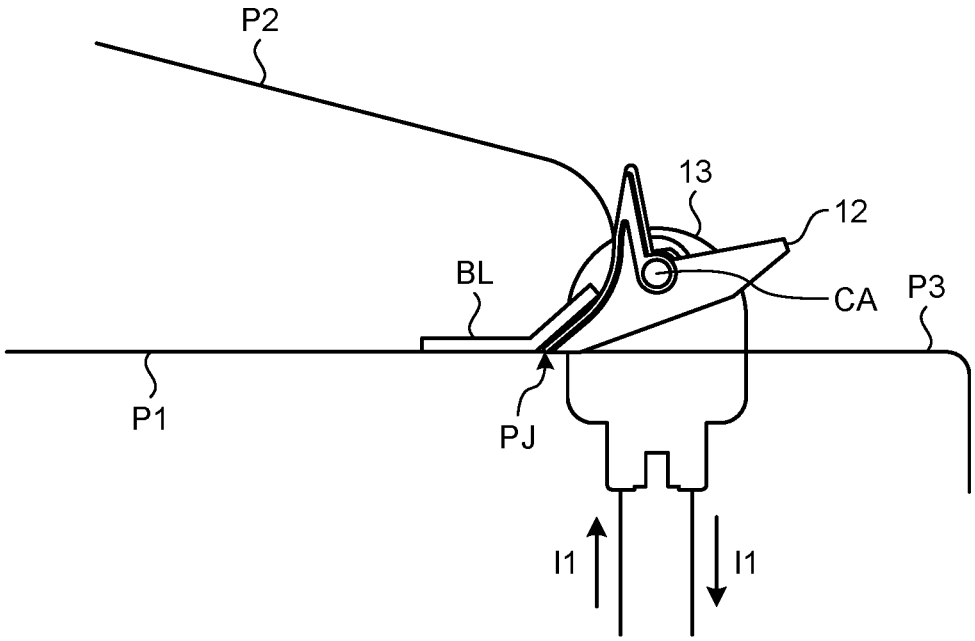
FIG. 2 is a diagram illustrating an example of a conveyance path connection mode according to the first embodiment.
Figure 3:
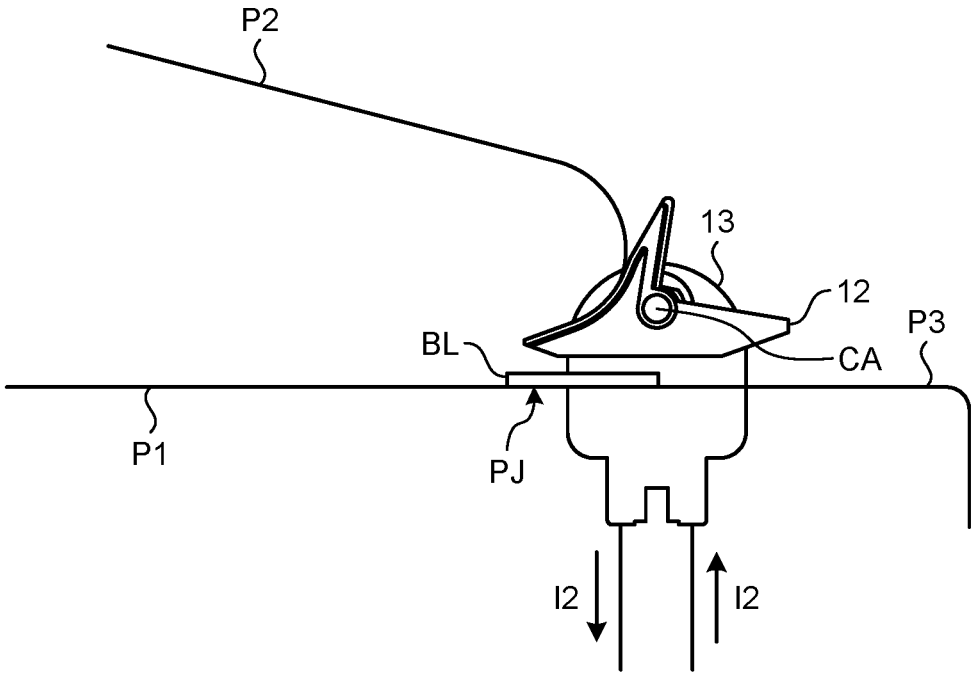
FIG. 3 is a diagram illustrating an example of a conveyance path connection mode according to the first embodiment.

FIGS. 2 and 3 are diagrams illustrating an example of a conveyance path connection mode according to the first embodiment. FIG. 2 illustrates a case where the conveyance path connection mode is in connection mode C1, and FIG. 3 illustrates a case where the conveyance path connection mode is in connection mode C2.

As illustrated in FIG. 2, when a current I1 flows in the solenoid 13, the switching claw 12 rotates to the left (counterclockwise) about the center axle CA, and the leftmost edge of the switching claw 12 makes contact with the conveyance path branch point PJ, and thus the conveyance path connection mode enters connection mode C1.

When the conveyance path connection mode is in connection mode C1, a banknote BL which is inserted into the access port 11 passes via the conveyance path P2, is folded back in the opposite direction along a left side of the switching claw 12, is conveyed toward the banknote inspection device 14 via conveyance path P1, and is inspected by the banknote inspection device 14. The inspected banknote BL advances further along conveyance path P1 and is temporarily stored in the temporary holding part 15.

When the denomination is unable to be discriminated or the serial number is unable to be recognized by the banknote inspection device 14 and the inspection result is "NG", the conveyance path connection mode is maintained in connection mode C1 and the banknote BL, which is being temporarily stored in the temporary holding part 15, is discharged from the temporary holding part 15, passes along conveyance path P1, and is folded back, at conveyance path branch point PJ, in the opposite direction along the left side of the switching claw 12 and returned to the access port 11 via conveyance path P2.

When the denomination has been discriminated and the serial number has been recognized by the banknote inspection device 14 and the inspection result is "OK", a current I2 in the opposite direction to current I1 flows in the solenoid 13 and the switching claw 12 rotates to the right (clockwise) about the center axle CA such that the leftmost edge of the switching claw 12 is separated from the conveyance path branch point PJ, as illustrated in FIG. 3, and thus the conveyance path connection mode enters connection mode C2.

When the conveyance path connection mode is in connection mode C2, the banknote PL, which has been temporarily stored in the temporary holding part 15, is discharged from the temporary holding part 15, passes along conveyance path P1, passes through the conveyance path branch point PJ so as to enter conveyance path P3, and advances along conveyance path P3 before being stored in any of stackers 16-1, 16-2, and 16-3 according to the discriminated denomination. For example, a ten-thousand yen note is stored in stacker 16-1, a five-thousand yen note is stored in stacker 16-2, and a one-thousand yen note is stored in stacker 16-3.

<Configuration of Banknote Inspection Device>

Figure 4:
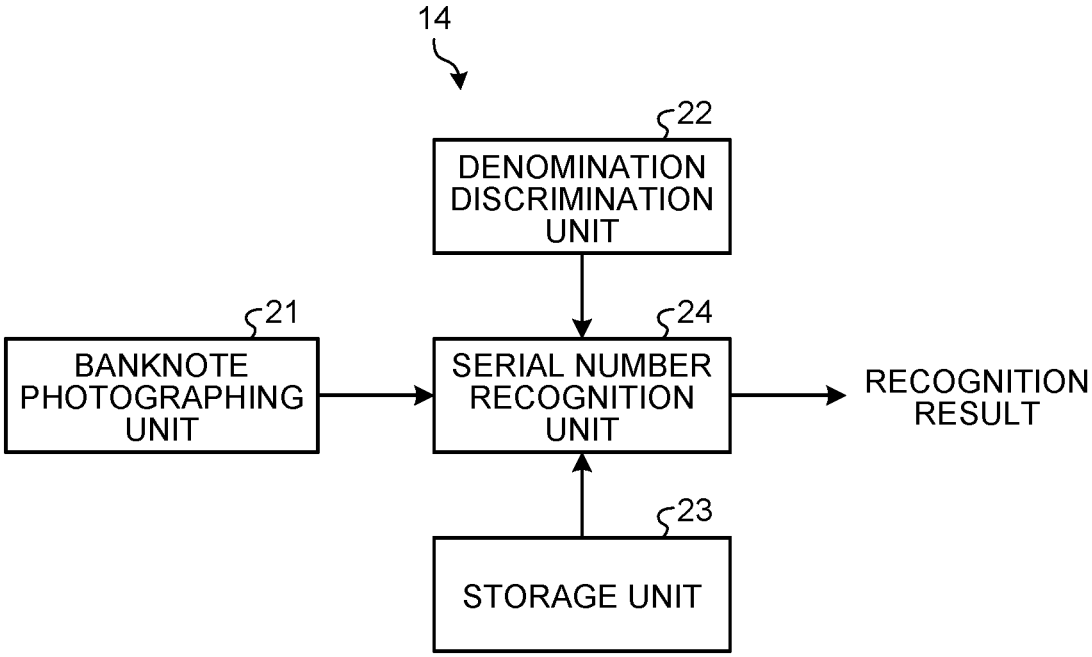
FIG. 4 is a diagram illustrating a configuration example of a banknote inspection device according to the first embodiment.

FIG. 4 is a diagram illustrating a configuration example of a banknote inspection device according to the first embodiment. In FIG. 4, the banknote inspection device 14 has a banknote photographing unit 21, a denomination discrimination unit 22, a serial number recognition unit 24, and a storage unit 23.

The banknote photographing unit 21 photographs banknote BL, which has been conveyed to the banknote inspection device 14, and outputs an image of the photographed banknote BL (sometimes referred to as "banknote image" hereinbelow) BLP to the serial number recognition unit 24.

The denomination discrimination unit 22 discriminates the denomination of the banknote BL conveyed to the banknote inspection device 14, and outputs information indicating the discriminated denomination (sometimes referred to hereinbelow as "denomination information") to the serial number recognition unit 24. The denomination discrimination unit 22 discriminates the denomination on the basis of the horizontal and vertical lengths of banknote BL and the pattern on the face of the banknote, and so forth, for example.

The storage unit 23 stores a learning model generated using a convolutional neural network (CNN).

The serial number recognition unit 24 uses the denomination information inputted from the denomination unit 22 and the learning model stored in the storage unit 23 to recognize the serial number of banknote BL on the basis of the banknote image BLP inputted from the banknote photographing unit 21, and outputs a recognition result.

<Processing and Operation of Serial Number Recognition Unit>

Figure 5:
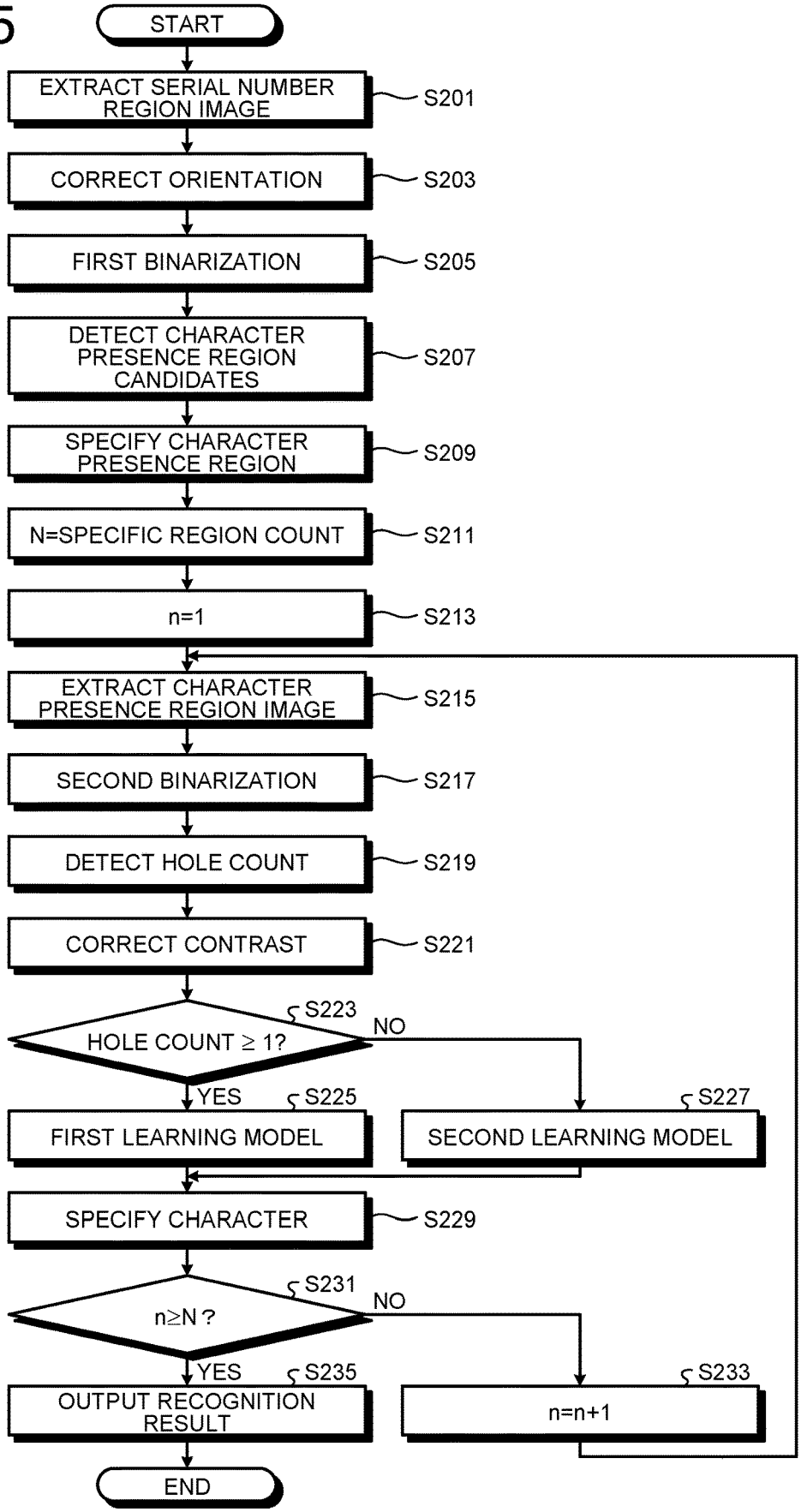
FIG. 5 is a flowchart used to illustrate a processing example of a serial number recognition unit according to the first embodiment.

FIG. 5 is a flowchart used to illustrate a processing example of a serial number recognition unit according to the first embodiment, and FIGS. 6 to 23 are diagrams used to illustrate an operation example of the serial number recognition unit according to the first embodiment.

Figure 6:
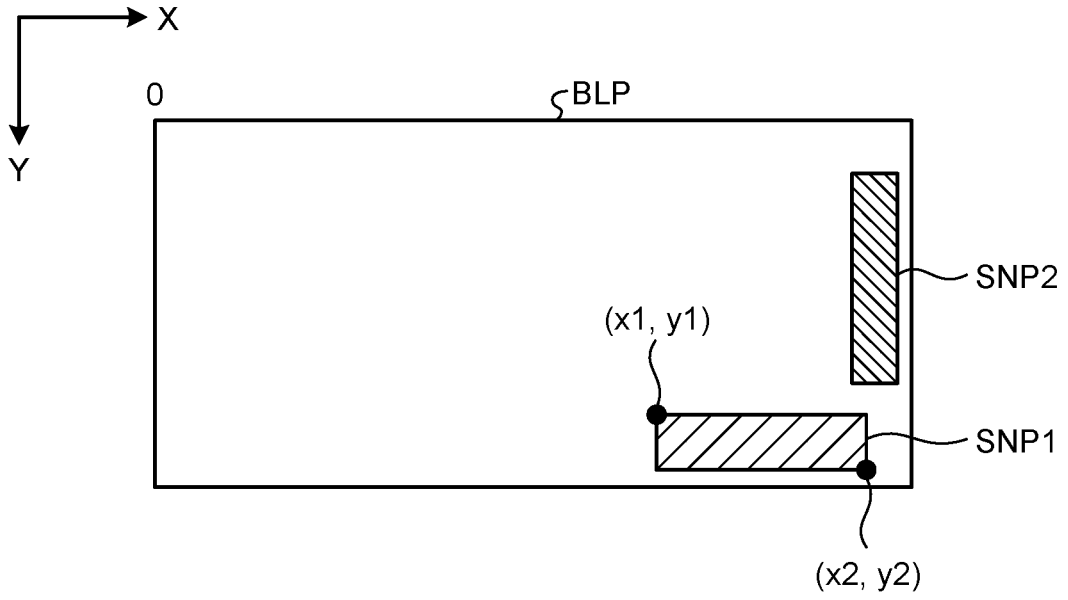
FIG. 6 is a diagram used to illustrate an operation example of the serial number recognition unit according to the first embodiment.

In FIG. 5, in Step S201, the serial number recognition unit 24 extracts, from the banknote image BLP, an image (sometimes also called a "serial number presence region image" hereinbelow) SNP1 or a serial number presence region image SNP2 of a region in which a serial number is present (sometimes called the "serial number presence region" hereinbelow) in the banknote image BLP, as illustrated in FIG. 6.

A serial number is represented by arranging numerical characters and alphabetic characters in a lateral direction, and hence the serial number presence region is a horizontally long, rectangular region. Furthermore, Bank of Japan banknotes, for example, have a serial number which is printed at a point in the bottom right of banknote BL when viewing banknote BL in a landscape orientation. Hence, when banknote BL is a Bank of Japan banknote, the serial number recognition unit 24 extracts the serial number presence region image SNP1, which has a horizontally long, rectangular shape, from a point in the bottom right of banknote image BLP, as illustrated in FIG. 6. For example, in a case where the top-left corner of the banknote image BLP is the origin 0 (zero) and where the horizontal axis is X and the vertical axis is Y, the top-left corner of the serial number presence region is represented by the coordinate (x1, y1), and the bottom-right corner of the serial number presence region is represented by the coordinate (x2, y2). Hence, when banknote Bk is a Bank of Japan banknote, the serial number recognition unit 24 extracts, from the banknote image BLP, an image of the rectangular region specified by coordinate (x1, y1) and coordinate (x2, y2) as a serial number presence region image SNP1.

Furthermore, in the case of a banknote of a specific foreign country, when banknote BL is viewed in a landscape orientation, the serial number is sometimes printed in a lateral direction along the right edge of banknote BL, as illustrated in FIG. 6. Thus, when banknote BL is a banknote of a specific foreign country, the serial number recognition unit 24 extracts, from a point on the right side of the banknote image BLP, a serial number presence region image SNP2 which has a vertically long, rectangular shape, as illustrated in FIG. 6.

The serial number presence region images SNP1 and SNP2 are sometimes collectively called the "serial number presence region images SNP" hereinbelow.

Figure 7:
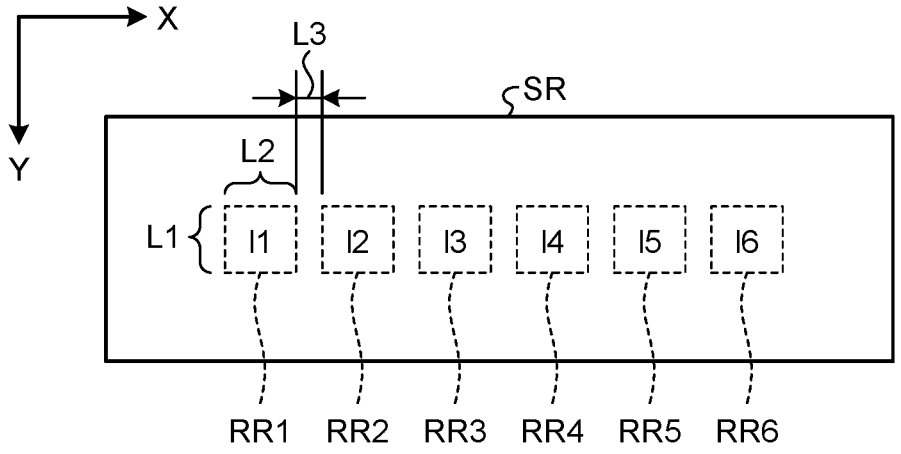
FIG. 7 is a diagram used to illustrate an operation example of the serial number recognition unit according to the first embodiment.

Here, as illustrated in FIG. 7, when the serial number of banknote BL is formed using six characters l1 to l6, in a serial number presence region SR, characters l1 to l6 are arranged in regions of a prescribed size (sometimes called "prescribed size regions" hereinbelow) RR1 to RR6, respectively, the horizontal and vertical lengths of which are denoted L1 and L2. The prescribed size regions RP1 to RR6 are all the same size, and the prescribed size regions RR1 to RR6 are positioned at equal intervals L3 from one another. The prescribed size regions RR1 to RR6 are sometimes referred to collectively as "the prescribed size regions RR" hereinbelow.

Returning to FIG. 5, next, in Step S203, the serial number recognition unit 24 corrects the orientation of the serial number presence region image by rotating the serial number presence region image through 90° when the serial number presence region image is an image with a vertically long, rectangular shape like the serial number presence region image SNP2 of FIG. 6. Due to this correction, the serial number presence region image SNP2 with a vertically long, rectangular shape is corrected to a serial number presence region image which has a horizontally long, rectangular shape like the serial number presence region image SNP1.

Thereafter, in Step S205, the serial number recognition unit 24 performs first binarization processing on the seral number presence region image SNP.

For example, as illustrated in FIG. 8, the serial number presence region image SNP is formed of 54 pixels, namely, the pixels (x, y)=pixel (1,1) to pixel (6,9), and assuming that the pixels have grayscale values which are the values illustrated in FIG. 8, the serial number recognition unit 24 performs first binarization processing as per binarization processing example 1 or binarization processing example 2 below.

<First Binarization Processing Example 1 (FIG. 9)>

The serial number recognition unit 24 binarizes the serial number presence region image SNP by using a fixed binarization threshold value TH1. Thus, when. the binarization threshold value TH1 is "210", for example, the serial number recognition unit 24 binarizes the serial number presence region image SNP by changing the grayscale values of the pixels with a grayscale value equal to or greater than 210 n FIGS. 8 to "255" and changing the grayscale values of the pixels with a grayscale value of less than 210 in FIG. 8 to "0", as illustrated in FIG. 9.

The serial number recognition unit 24 may also set a binarization threshold value TH1 which has a value corresponding to the denomination indicated by the denomination information outputted from the denomination discrimination unit 22.

<First Binarization Processing Example 2 (FIGS. 10, 11)>

Figure 10:
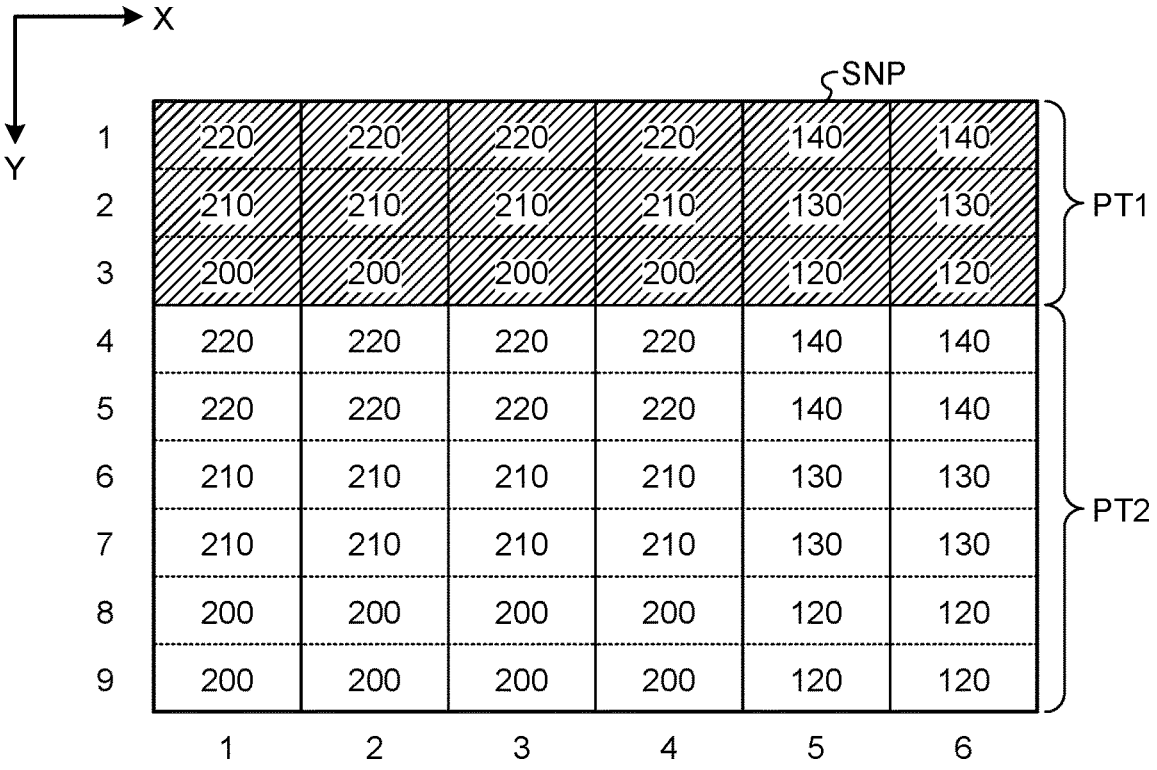
FIG. 10 is a diagram used to illustrate an operation example of the serial number recognition unit according to the first embodiment.
Figure 11:
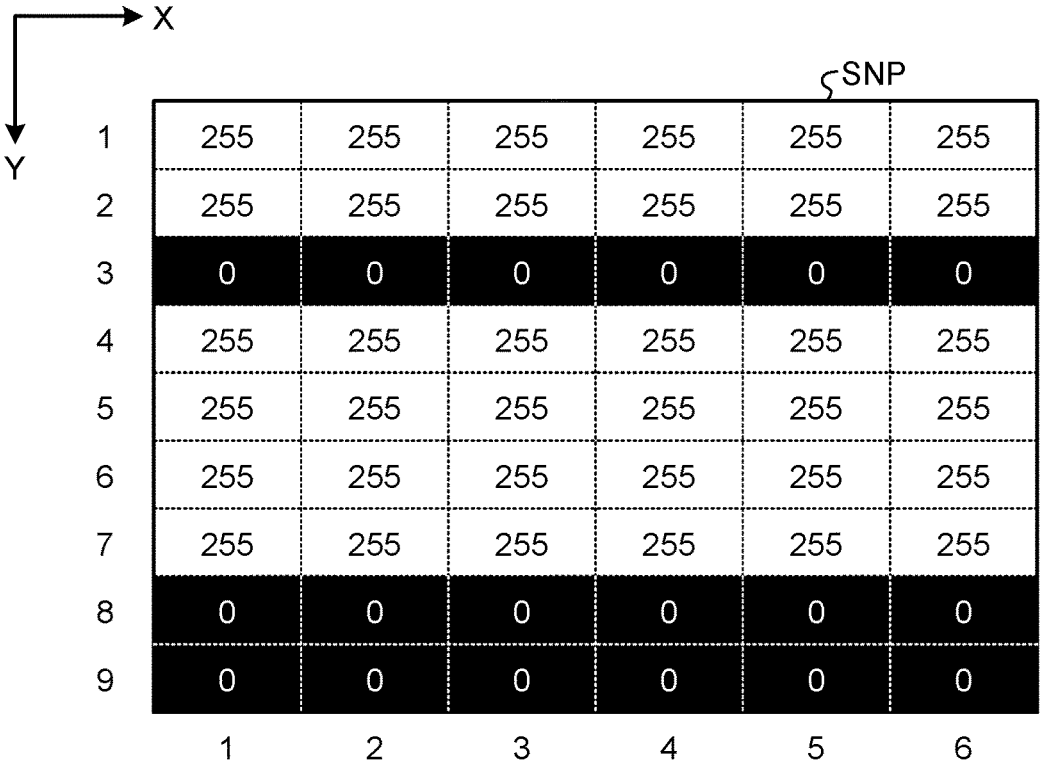
FIG. 11 is a diagram used to illustrate an operation example of the serial number recognition unit according to the first embodiment.

First, as illustrated in FIG. 10, the serial number recognition unit 24 configures a first portion PT1 and a second portion PT2 among the plurality of pixels contained in the serial number presence region image SNP. Thereafter, among the 54 pixels, namely, pixel (1, 1) to pixel (6, 9), the serial number recognition unit 24 calculates an average value for the grayscale values of the first portion PT1 in each column, and sets the calculated average value as a binarization threshold value TH2 for columns which are taken as the object of the average value calculation. Thus, for example, the binarization threshold value TH2 of the first to fourth columns is calculated to be (220+210+200)/3=210, and the binarization threshold value TH2 of the fifth and sixth columns is calculated to be (140+130+120)/2=130. Thus, for each column of the 54 pixels, namely, pixel (1,1) to pixel (6,9), the serial number recognition unit 24 uses the first portion PT1 to calculate the binarization threshold value TH2 of each column. Thus, because the binarization threshold value TH2 is "210" for the first to fourth columns, the serial number recognition unit 24 binarizes the serial number presence region image SNP by changing the grayscale values of the pixels with a grayscale value equal to or greater than 210 in FIG. 10 to "255" and changing the grayscale values of the pixels with a grayscale value of less than 210 in FIG. 10 to "0", as illustrated in FIG. 11. Furthermore, because the binarization threshold value TH2 is "130" for the fifth and sixth columns, the serial number recognition unit 24 binarizes the serial number presence region image SNP by changing the grayscale values of the pixels with a grayscale value equal to or greater than 130 in FIG. 10 to "255" and changing the grayscale values of the pixels with a grayscale value of less than 130 in FIG. 10 to "0", as illustrated in FIG. 11.

First binarization processing examples 1 and 2 have been described hereinabove.

Returning to FIG. 5, next, in Step S207, the serial number recognition unit 24 detects, in the serial number presence region image SNP, candidates (sometimes called "character presence region candidates" hereinbelow) for a region (sometimes called a "character presence region" hereinbelow) CR in which a character image forming the serial number of the banknote BL (sometimes called a "character image" hereinbelow) is present. The serial number recognition unit 24 detects the character presence region candidates by using "boundary tracing", which is the typical method for tracing figure pixels adjacent to the background in a binarized image, for example.

Figure 12:
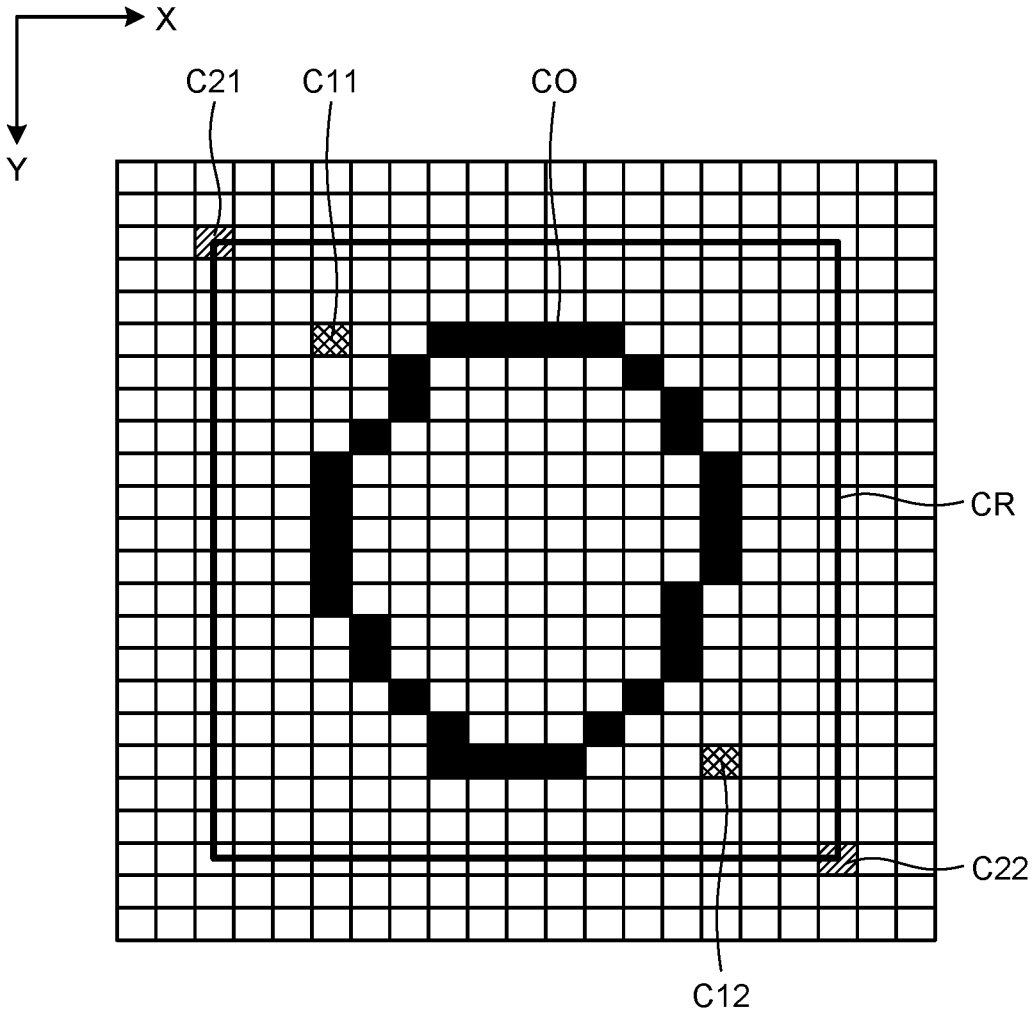
FIG. 12 is a diagram used to illustrate an operation example of the serial number recognition unit according to the first embodiment.

First, by applying boundary tracing to a serial number presence region image SNP which has undergone first binarization, the serial number recognition unit 24 detects an outline (sometimes called the "image outline" hereinbelow) CO of an image contained in the serial number presence region image SNP which has undergone first binarization, as illustrated in FIG. 12. Next, the serial number recognition unit 24 detects, among a plurality of pixels (x, y) forming the image outline CO, a minimum value xmin for an K coordinate, a minimum value ymin for a Y coordinate, a maximum value xmax for an X coordinate, and a maximum value ymax for a Y coordinate. Thereafter, the serial number recognition unit 24 specifies, in the serial number presence region image SNP, a coordinate C11=(xmin, ymin), which has a minimum value xmin and a minimum value ymin, and a coordinate C12=(xmax, ymax), which has a maximum value xmax and a maximum value ymax. Next, the serial number recognition unit 24 specifies, in the serial number presence region image SNP, a coordinate C21, which is at a predetermined distance from coordinate C11 (for example, a distance of three pixels in a −X direction and three pixels in a −Y direction), and a coordinate C22, which is at a predetermined distance from coordinate C12 (for example, a distance of three pixels in a +X direction and three pixels in a direction). Further, the serial number recognition unit 24 detects, as a candidate for character presence region CR, a rectangular region having a top-left corner at coordinate C21 and a bottom-right corner at coordinate C22. In Step S207, the serial number recognition unit 24 detects, as mentioned earlier, a plurality of character presence region candidates in the serial number presence region image SNP.

Returning to FIG. 5, next, in Step S209, the serial number recognition unit 24 specifies character presence regions on the basis of the plurality of character presence region candidates detected in Step S207. Specific examples 1 to 10 are provided hereinbelow as specific examples of character presence regions.

<Specific Example 1 of Character Presence Regions (FIG. 13)>

Figure 13:
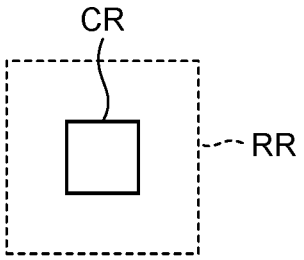
FIG. 13 is a diagram used to illustrate an operation example of the serial number recognition unit according to the first embodiment.

As illustrated in FIG. 13, the serial number recognition unit 24 specifies a character presence region in the serial number presence region image SNP by excluding, from among the plurality of candidates for the character presence region detected in Step S207, candidates for which the size of the character presence region CR is less than a predetermined size SZ1 which has been set on the basis of the size of the prescribed size region RR. For example, the predetermined size SZ1 is set at one half the size of the prescribed size region RR.

<Specific Example 2 of Character Presence Regions (FIG. 14)>

Figure 14:
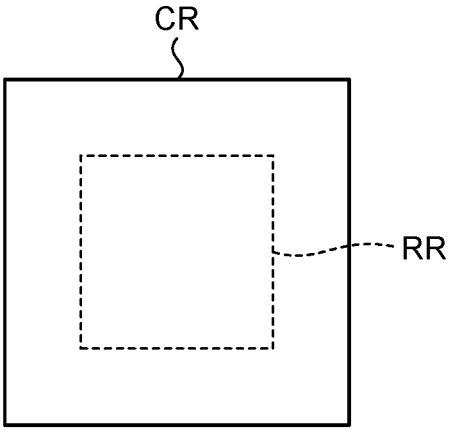
FIG. 14 is a diagram used to illustrate an operation example of the serial number recognition unit according to the first embodiment.

As illustrated in FIG. 14, the serial number recognition unit 24 specifies a character presence region in the serial number presence region image SNP by excluding, from among the plurality of candidates for the character presence region detected in Step S207, candidates for which the size of the character presence region CR is equal to or greater than a predetermined size SZ2 which has been set on the basis of the size of the prescribed size region RR. For example, the predetermined size SZ2 is set at two times the size of the prescribed size region RR.

<Specific Example 3 of Character Presence Regions (FIG. 15)>

Figure 15:
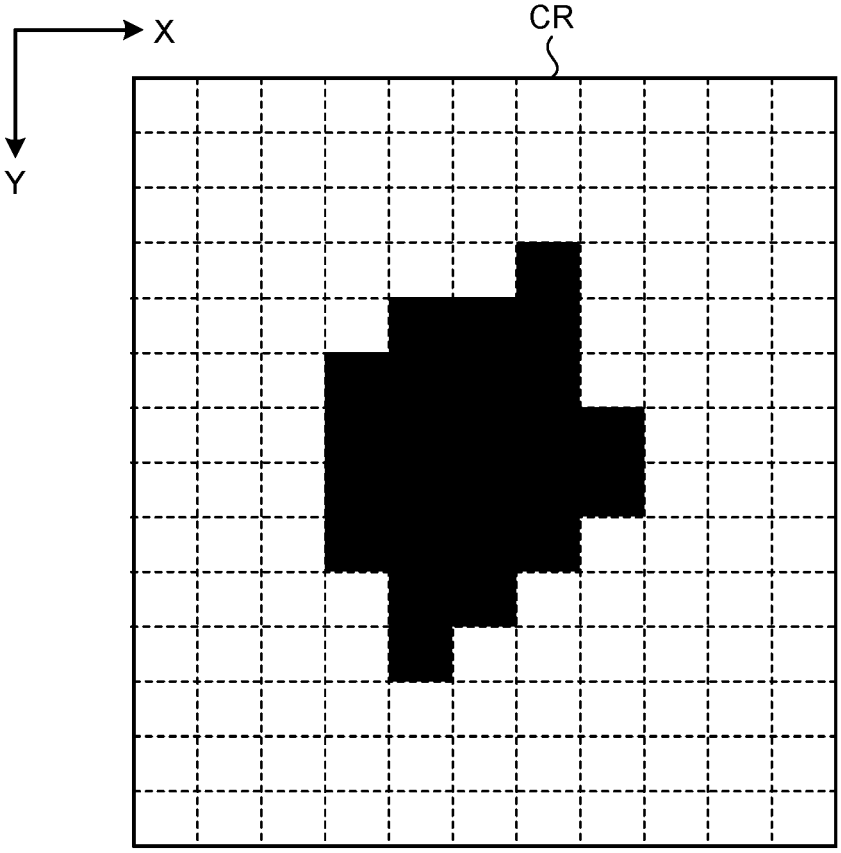
FIG. 15 is a diagram used to illustrate an operation example of the serial number recognition unit according to the first embodiment.

As illustrated in FIG. 15, the serial number recognition unit 24 specifies a character presence region in the serial number presence region image SNP by excluding, from among the plurality of candidates for the character presence region detected in Step S207, candidates for which the proportion of black pixels (that is, pixels having a grayscale value of "0" due to the first binarization) relative to white pixels (that is, pixels having a grayscale value of "255" due to the first binarization) in the character presence region CR is equal to or greater than a predetermined value THR. The predetermined value THR is set at 20%, for example.

<Specific Example 4 of Character Presence Regions (FIG. 16)>

Figure 16:
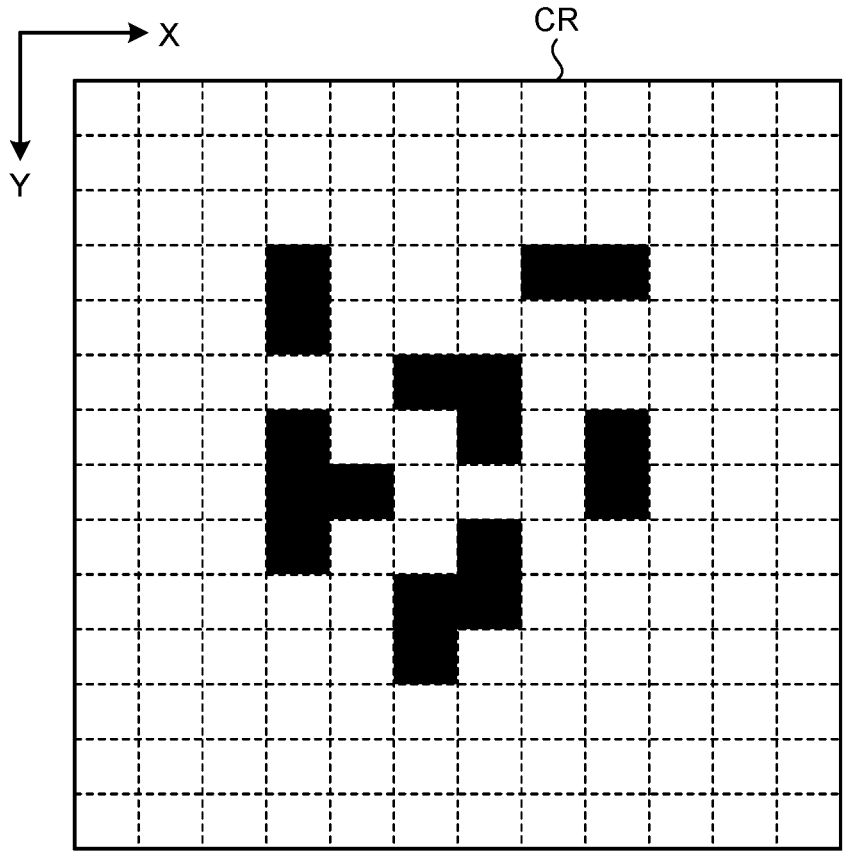
FIG. 16 is a diagram used to illustrate an operation example of the serial number recognition unit according to the first embodiment.

As illustrated in FIG. 16, the serial number recognition unit 24 specifies a character presence region in the serial number presence region image SNP by excluding, from among the plurality of candidates for the character presence region detected in Step S207, candidates for which the quantity of black pixels distributed in the character presence region CR is equal to or greater than a predetermined value THN. For the quantity of black pixels distributed in the character presence region CR, a series of black pixels extending in a vertical, horizontal, or oblique direction is counted as one unit. FIG. 16 illustrates, as an example, a case where the quantity of distributed black pixels is "6".

<Specific Example 5 of Character Presence Regions (FIG. 17)>

Figure 17:
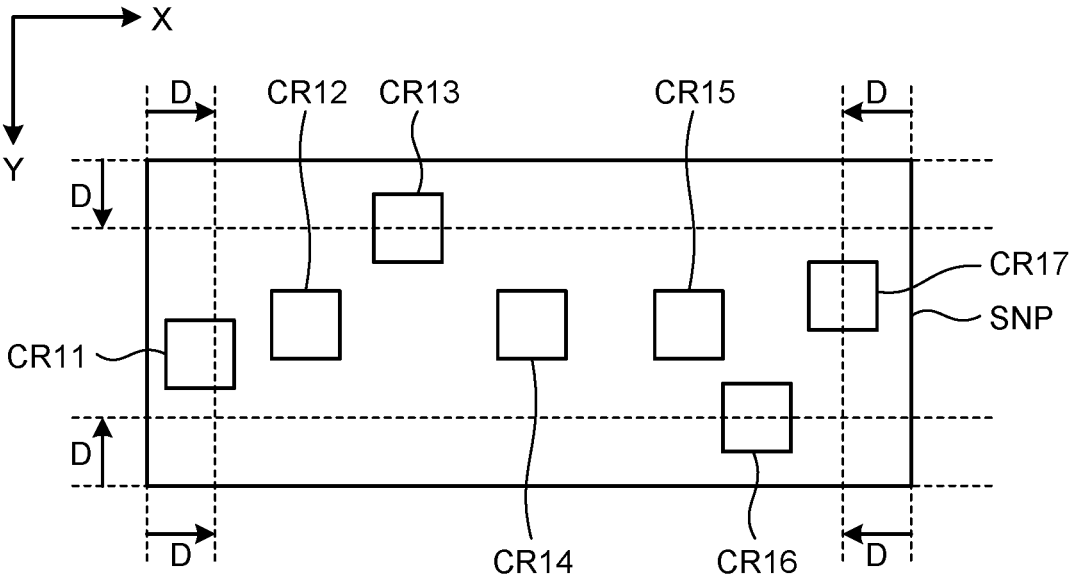
FIG. 17 is a diagram used to illustrate an operation example of the serial number recognition unit according to the first embodiment.

As illustrated in FIG. 17, the serial number recognition unit 24 specifies a character presence region in the serial number presence region image SNP by excluding, from among the plurality of candidates for the character presence region detected in Step S207, candidates which are at no more than a predetermined distance D from each edge of the serial number presence region image SNP. For instance, in the example illustrated in FIG. 17, among a plurality of candidates CR11 to CR17 for the character presence region, candidate CR11 is at no more than the predetermined distance D from the left edge of the serial number presence region image SNP, candidate CR13 is at no more than the predetermined distance D from the top edge of the serial number presence region image SNP, candidate CR16 is at no more than the predetermined distance D from the bottom edge of the serial number presence region image SNP, and candidate CR17 is at no more than the predetermined distance D from the right edge of he serial number presence region image SNP. Hence, in the example illustrated in FIG. 17, candidates CR11, CR13, CR16, and CR17 are excluded from the plurality of candidates CR11 to CR17 for the character presence region, and the character presence regions CR12, CR14, and CR15 are specified as character presence regions in the serial number presence region image SNP.

<Specific Example 6 of Character Presence Regions (FIG. 18)>

Figure 18:
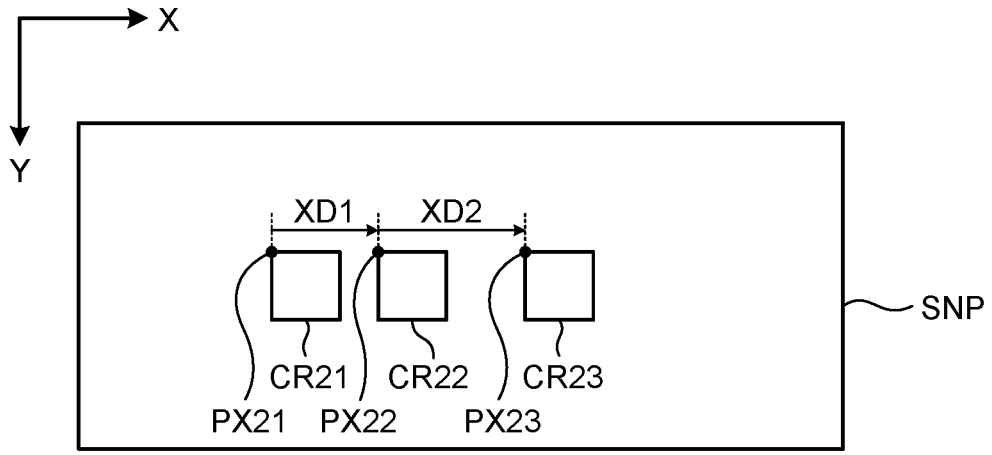
FIG. 18 is a diagram used to illustrate an operation example of the serial number recognition unit according to the first embodiment.

As illustrated in FIG. 18, the serial number recognition unit 24 acquires X coordinates PX21, PX22, and PX23 in the top-left corner of each of the plurality of candidates CR21, CR22, and CR23 for the character presence region detected in Step S207 and sorts the X coordinates PX21, PX22, and PX23 in ascending order. Thereafter, the serial number recognition unit 24 calculates a distance XD1 of X coordinate PX22 relative to X coordinate PX21 as the distance of candidate CR22 relative to candidate CR21 and then calculates a distance XD2 of the X coordinate PX23 relative to X coordinate PX22 as the distance of candidate CR23 relative to candidate CR22, according to the sort order. Further, the serial number recognition unit 24 specifies character presence regions in the serial number presence region image SNP by excluding candidates for which the calculated distance is equal to or greater than a predetermined value THX. For example, in FIG. 18, when distance XD1 is less than the predetermined value THX and distance XD2 is equal to or greater than the predetermined value THX, candidate CR23 is excluded from the plurality of candidates CR21, CR22, and CR23 for the character presence region, and character presence regions CR21 and CR22 are specified as character presence regions in the serial number presence region image SNP.

<Specific Example 7 of Character Presence Regions (FIG. 19)>

Figure 19:
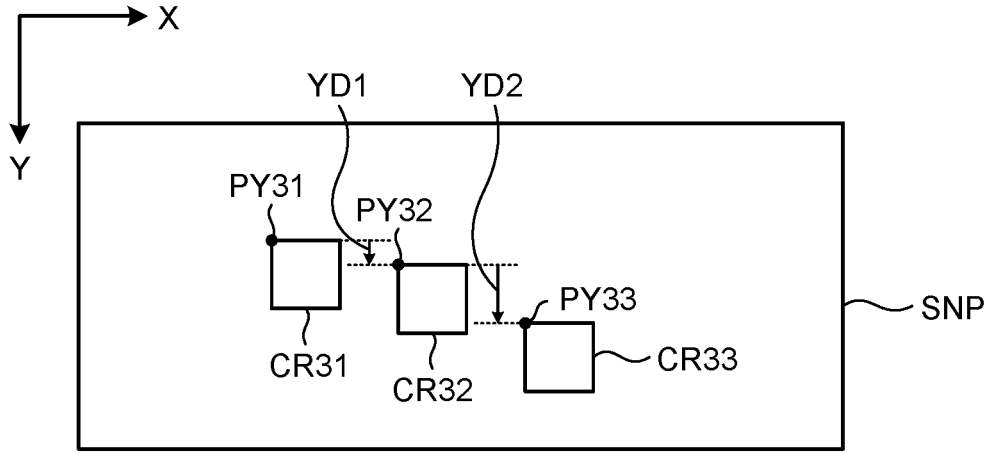
FIG. 19 is a diagram used to illustrate an operation example of the serial number recognition unit according to the first embodiment.

As illustrated in FIG. 19, the serial number recognition unit 24 acquires Y coordinates PY31, PY32, and PY33 in the top-left corner of each of the plurality of candidates CR31, CR32, and CR33 for the character presence region detected in Step S207 and sorts the Y coordinates PY31, PY32, and PY33 in ascending order. Thereafter, the serial number recognition unit 24 calculates a distance YD1 of Y coordinate PY32 relative to Y coordinate PY31 as the distance of candidate CR32 relative to candidate CR31 and then calculates a distance YD2 of the Y coordinate PY33 relative to Y coordinate PY32 as the distance of candidate CR33 relative to candidate CR32, according to the sort order. Further, the serial number recognition unit 24 specifies character presence regions in the serial number presence region image SNP by excluding candidates for which the calculated distance is equal to or greater than a predetermined value THY. For example, in FIG. 19, when distance YD1 is less than the predetermined value THY and distance YD2 is equal to or greater than the predetermined value THY, candidate CR33 is excluded from the plurality of candidates CR31, CR32, and CR33 for the character presence region, and character presence regions CR31 and CR32 are specified as character presence regions in the serial number presence region image SNP.

<Specific Example 8 of Character Presence Regions (FIG. 20)>

Figure 20:
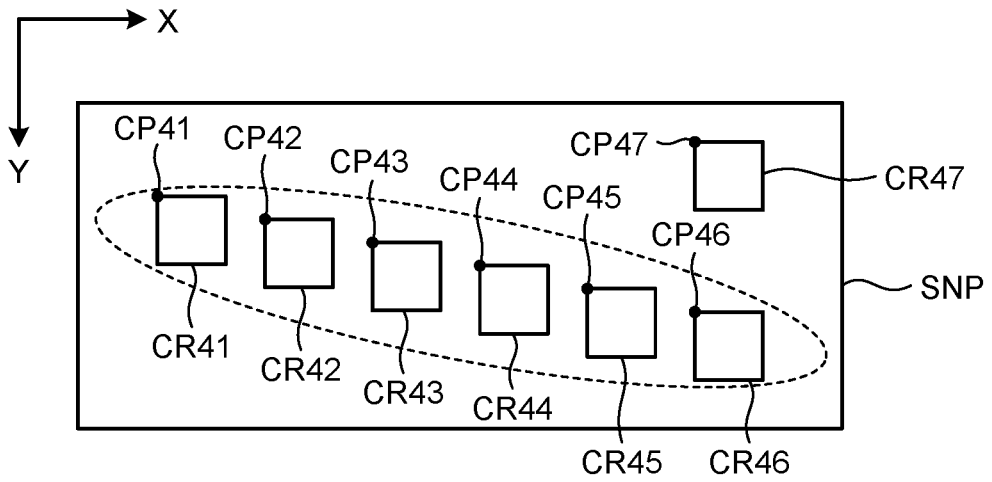
FIG. 20 is a diagram used to illustrate an operation example of the serial number recognition unit according to the first embodiment.
Figure 21:
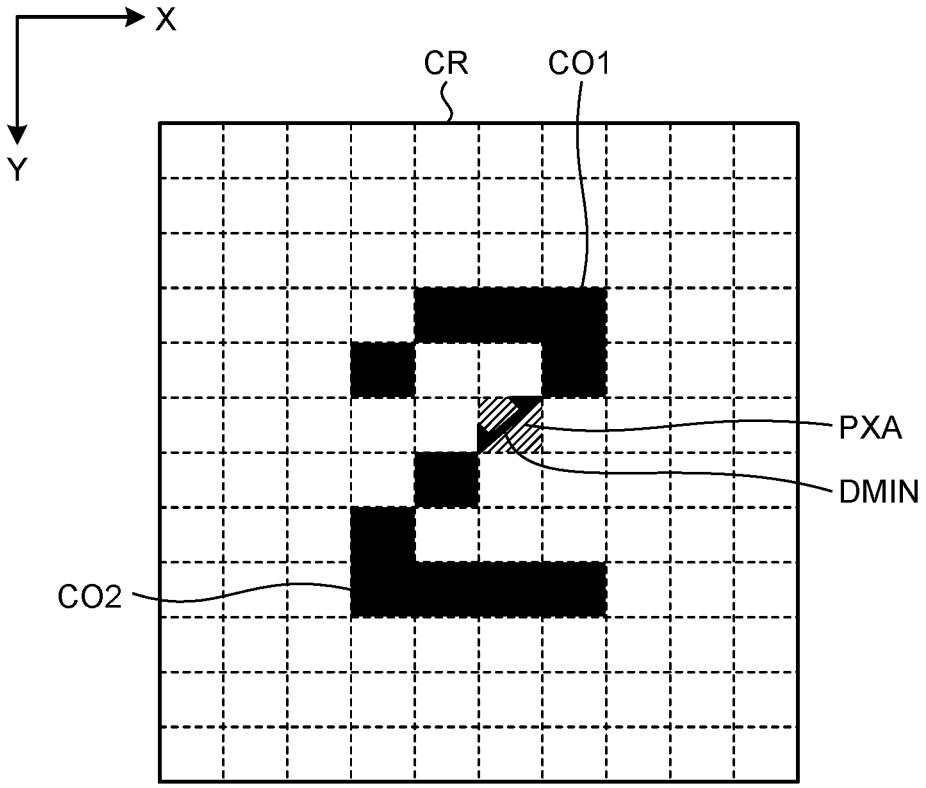
FIG. 21 is a diagram used to illustrate an operation example of the serial number recognition unit according to the first embodiment.

In the example illustrated in FIG. 20, the serial number recognition unit 24 first acquires coordinates CP41 to CP47 in the top-left corner of the plurality of candidates CR41 to CR47, respectively, for the character presence region. Thereafter, the serial number recognition unit 24 calculates the average value of the coordinates CP41 to CP47 (sometimes called "the coordinate average value" hereinbelow). Next, the serial number recognition unit 24 calculates the Mahalanobis distance between the top-left corner coordinate and the coordinate average value for each of the candidates CR41 to CR47. Further, the serial number recognition unit 24 specifies character presence regions in the serial number presence region image SNP by excluding candidates for which the calculated Mahalanobis distance is equal to or greater than a predetermined value THM. For example, in FIG. 20, when the Mahalanobis distance for each of candidates CR41 to CR46 is less than the predetermined value THM, yet the Mahalanobis distance of candidate CR47 is equal to or greater than the predetermined value THM, candidate CR47 is excluded from the plurality of candidates CR41 to CR47 for the character presence region, and character presence regions CR41 to CR46 are specified as character presence regions in the serial number presence region image SNP.

Here, the foregoing specific examples 7, 8, and 9 (FIGS. 18, 19, and 20) share a point of commonality in that the serial number recognition unit 24 excludes candidates for which the distance from the other candidates is equal to or greater than a predetermined value from the plurality of candidates for the character presence region.

<Specific Example 9 of Character Presence Regions (FIG. 21)>

The serial number recognition unit 24 specifies, from among the candidates for the character presence region detected in Step S207, a character presence region in the serial number presence region image SNP by integrating two image outlines when the shortest distance between two image outlines in the character presence region is less than a predetermined value THL. For example, in the example illustrated in FIG. 21, when, in the character presence region CR, a shortest distance DMIN between an image outline CO1 and an image outline CO2 is less than a predetermined value THL, the serial number recognition unit 24 produces one image outline by integrating image outline CO1 with image outline CO2 by compensating for a pixel PXA between image outline CO1 and image outline CO2.

<Specific Example 10 of Character Presence Regions (FIG. 22)>

Figure 22:
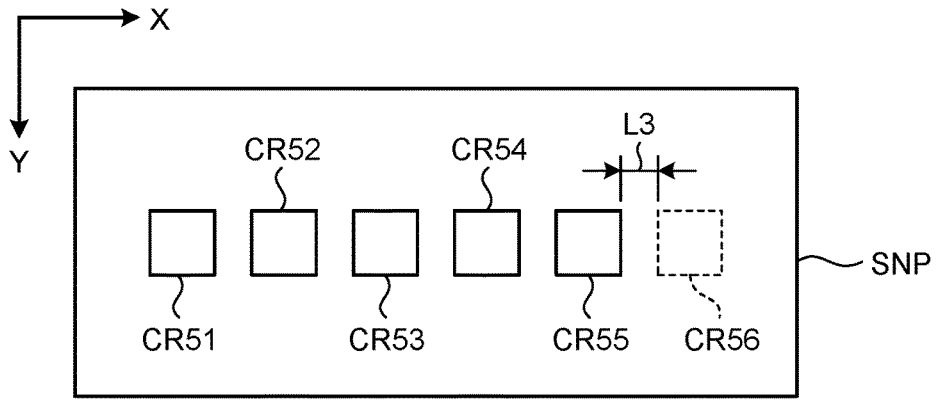
FIG. 22 is a diagram used to illustrate an operation example of the serial number recognition unit according to the first embodiment.

When the quantity of candidates for the character presence region detected in Step S207 is less than the quantity of characters forming the serial number of banknote BL, the serial number recognition unit 24 specifies character presence regions in the serial number presence region image SNP by adding a new character presence region on the basis of the quantity of characters forming the serial number of banknote BL. For example, when the serial number of banknote BL is formed by six characters as illustrated in FIG. 7, yet the candidates for the character presence region detected in Step S207 are five candidates, namely, candidates CR51 to CR55 as illustrated in FIG. 22, the quantity of candidates for the character presence region is smaller than the quantity of characters forming the serial number of banknote BL. Further, in the example illustrated in FIG. 22, there is a difference of one between the quantity (five) of candidates for the character presence region and the quantity (six) of characters forming the serial number of banknote BL. Hence, in the example illustrated in FIG. 22, the serial number recognition unit 24 specifies a character presence region in the serial number presence region image SNP by adding one new character presence region CR56 in addition to candidates CR51 to CR55. For example, the serial number recognition unit 24 adds the character presence region CR56 in a position at an interval L3 (FIG. 7) from candidate CRSS which is in the rightmost position among candidates CR51 to CR55.

Specific examples 1 to 10 of character presence regions have been described hereinabove. By applying any one or a plurality of the foregoing specific examples 1 to 10 to the plurality of character presence region candidates detected in Step S207, the character presence regions specified in Step S209 are each specified as a region where a character image is present.

Returning to FIG. 5, next, in Step S211, the serial number recognition unit 24 sets the quantity of character presence regions specified in Step S209 (sometimes called the "specific region count" hereinbelow) as "N".

Thereafter, in Step S213, the serial number recognition unit 24 sets the value of a counter n as "n=1".

By taking each of the plurality of character presence regions specified in Step S209 as a processing object, the processing of Steps S215 to S229 is carried out in order, starting with the leftmost character presence region in the serial number presence region image SNP and moving to the right, as counter n increases.

In Step S215, the serial number recognition unit 24 sets the character presence region CR specified in Step S209 as the banknote image BLP and extracts an image of the character presence region CR (sometimes called a "character presence region image" hereinbelow) from the banknote image BLP. The character presence region image includes a character image.

Thereafter, in Step S217, the serial number recognition unit 24 performs second binarization processing on the character presence region image extracted in Step S215. In the second binarization processing, the serial number recognition unit 24 binarizes the character presence region image by using "Otsu's binarization", which is the typical binarization method, for example.

Next, in Step S219, the serial number recognition unit 24 uses "boundary tracing", which is the same method as used in Step S207, for example, to detect a character image in the character presence region image which has undergone the second binarization, and detects "the quantity of holes" included in the detected character image (sometimes called the "hole count" hereinbelow). Here, characters likely to form the serial number of banknote BL include any characters among the ten numerical characters 0 to 9 and the twenty-six alphabet characters A to Z. Among these 36 characters, there are no holes among the characters which are the numerical characters 1, 2, 3, 5, and 7 or the alphabetic characters C, E, F, G, H, I, J, K, L, M, N, S, T, U, V, N, X, F, Z, one hole in each of the characters which are the numerical characters 0, 4, 6, and 9 and the alphabetic characters A, D, O, P, and R, and two holes in each of the characters which are the numerical character 8 and the alphabetic characters B and Q.

Figure 23:
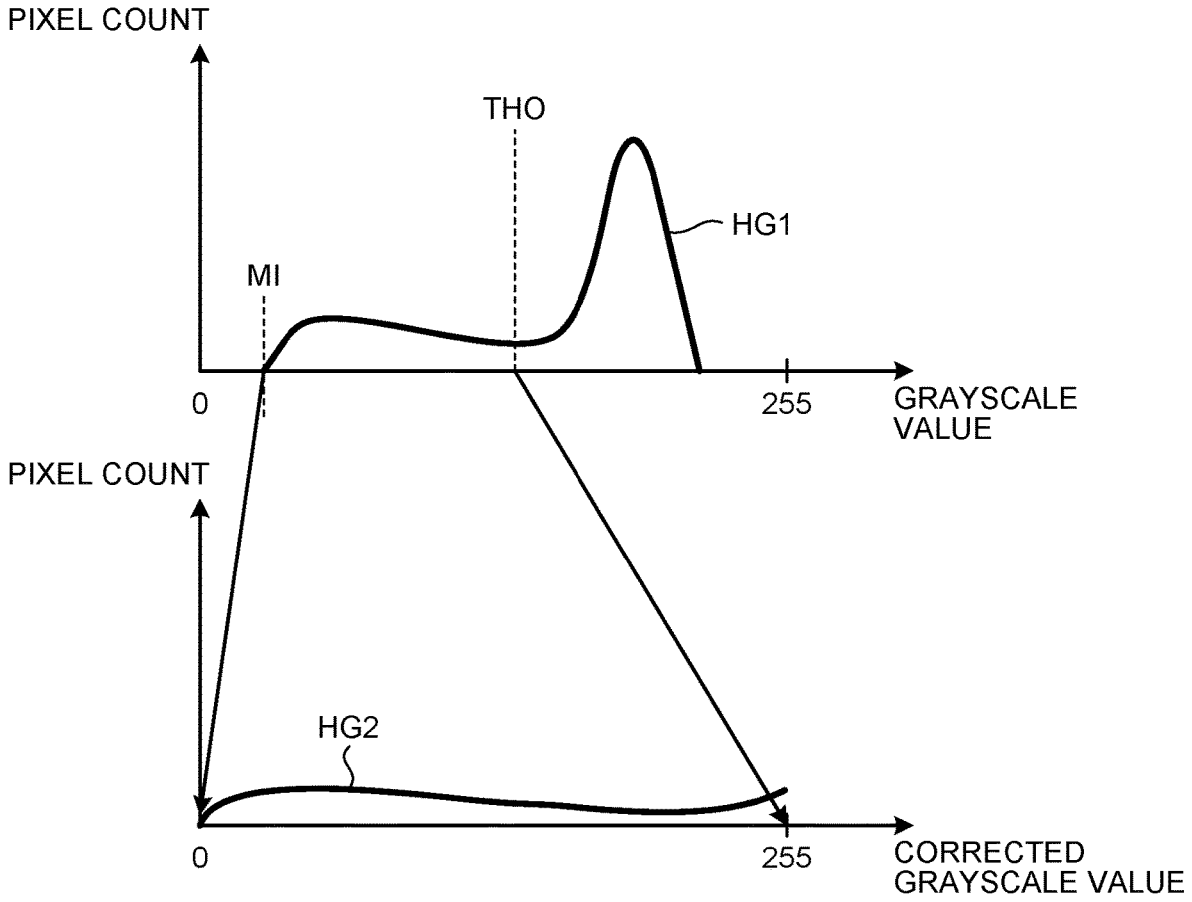
FIG. 23 is a diagram used to illustrate an operation example of the serial number recognition unit according to the first embodiment.

Next, in Step S221, the serial number recognition unit 24 uses a binarization threshold value THO, which is calculated when performing Otsu's binarization in Step S217, to correct the contrast of the character presence region image prior to the second binarization. As illustrated in FIG. 23, the serial number recognition unit 24 first determines a histogram HG1 for the whole of the character presence region image. Next, the serial number recognition unit 24 sets the binarization threshold value THO for the histogram HG1. Further, the serial number recognition unit 24 detects the minimum value MI of the grayscale values in the histogram HG1. In addition, the serial number recognition unit 24 changes the grayscale values of pixels having a grayscale value equal to or greater than the binarization threshold value THO among all the pixels forming the character presence region image to "255". Furthermore, the serial number recognition unit 24 corrects the contrast of the character presence region image by correcting, on the basis of the minimum value MI and the binarization threshold value THO, the grayscale values of the pixels, among all the pixels forming the character presence region image, which have grayscale values between the minimum value MI and the binarization threshold value THO (sometimes called the "pixels of interest" hereinbelow). For example, as illustrated in FIG. 23, the serial number recognition unit 24 corrects the grayscale values of the pixels of interest by changing the histogram HG1 to histogram HG2 so that the minimum value MI is grayscale value "0" and the binarization threshold value THO is grayscale value "255". Thus, for example, the grayscale values of the pixels of interest which have a grayscale value which is the minimum value MI are corrected to "0", and the grayscale values of the pixels of interest which have a grayscale value which is the binarization threshold value THO are corrected to "255". Such contrast correction enables an increase in the ratio of the grayscale values of the character part on, which represents the object of recognition, to the grayscale values of the background portion representing noise in the character presence region image by improving the contrast of the character presence region image. Accordingly, at the time of the character recognition in the following Steps S225 and S227, the accuracy of the character recognition can be improved because the effect of the background portion constituting noise can be kept to a minimum.

Returning to FIG. 5, next, in Step S223, the serial number recognition unit 24 determines whether the hole count detected in Step S219 is one or greater, that is, whether the character image has holes. When there are holes in the character image (Step S223: Yes), the processing advances to Step S225, and when there axe no holes in the character image (Step S223: No), the processing advances to Step S227.

Here, the storage unit 23 stores a first learning model and a second learning model. The first learning model is a learning model which is generated using a CNN by taking, as training data, only images of the characters 0, 4, 6, 8, 9, A, D, O, P, R, B, and Q with holes, among the characters 0 to 9 and A to Z, which will likely be used for the serial number of banknote BL, and while disregarding, as training data, images of the characters 1, 2, 3, 5, 7, C, E, F, G, H, I, J, K, L, M, N, S, T, U, V, W, X, Y, and Z without holes. Meanwhile, the second learning model is a learning model which is generated using a CNN by taking, as training data, only images of the characters 1, 2, 3, 5, 7, C, E, F, G, H, I, J, K, L, M, N, S, T, U, V, W, X, Y, and Z without holes, among the characters 0 to 9 and A to Z, which will likely be used for the serial number of banknote BL, and while disregarding, as training data, images of the characters 0, 4, 6, 8, 9, A, D, O, P, R, B, and Q with holes.

Hence, when the determination of Step S223 is "Yes", the serial number recognition unit 24 uses the first learning model to perform, in Step S225, character recognition using a CNN on the contrast-corrected character presence region image. On the other hand, when the determination of Step S223 is "No", the serial number recognition unit 24 uses the second learning model to perform, in Step S227, character recognition using a CNN on the contrast-corrected character presence region image. As a result of the processing of Steps S225 and S227, the serial number recognition unit 24 acquires characters recognized through character recognition and scores for the characters. After the processing of Step S225 or Step S227, the processing advances to Step S229.

In Step S229, the serial number recognition unit 24 specifies the characters contained in the character presence region image. For example, a case is assumed where, in the processing of Step S225 or Step S227, nine characters, namely 0 to 9, are recognized and a score of 0.9765 is assigned to "0", a score of 0.005 is assigned to "1", a score of 0.004 is assigned to "2", a score of 0.003 is assigned to "3", a score of 0.03 is assigned to "4", a score of 0.04 is assigned to "5", a score of 0.865 is assigned to "6", a score of 0.06 is assigned to "7", a score of 0.05 is assigned to "8", and a score of 0.654 is assigned to "9". In this case, the serial number recognition unit 24 specifies "0", which has the largest score, as a character which contained in the character presence region image.

Here, the serial number recognition unit 24 may determine that the character contained in the character presence region image is unknown in a case where the absolute value of the difference in score between the character with the largest score and the character with the second largest score is less than a predetermined value THS. For example, when the threshold value THS is set at 0.15, in the foregoing example, the score assigned to character "0" with the largest score is 0.9765 and the score assigned to character "6" with the second largest score is 0.865, and thus the absolute value of the difference between the scores is 0.1115, which is less than threshold value THS, and hence the serial number recognition unit 24 determines that the character contained in the character presence region image is unknown.

In addition, for example, the serial number recognition unit 24 may determine that the character contained in the character presence region image is unknown in a case where the quantity of holes present in the character with the largest score does not match the hole count detected in Step S219.

The serial number recognition unit 24 may also, for example, detect the circumference of the character image by using boundary tracing, normalize the detected circumference according to equation (1), and when the character with the largest score is not present in the group of characters corresponding to the normalized circumference P, determine that the character contained in the character presence region image is unknown in equation (1), "D" denotes the circumference of the character image detected using boundary tracing, "W" denotes the width of the character image, and "H" denotes the height of the character image.

$$\text{Normalized circumference } P=D/\text{SQRT}(W\times H) \quad (1)$$

Thereafter, in Step S231, the serial number recognition unit 24 determines whether the value of counter n has reached a specific region count N. When the value of counter n has not reached the specific region count N (Step S231: No), the processing advances to Step S233, and when the value of counter n has reached the specific region count N (Step S231: Yes), the processing advances to Step S235.

In Step S233, the serial number recognition unit 24 increments the value of counter n. After the processing of Step S233, the processing returns to Step S215.

Meanwhile, in Step S235, the serial number recognition unit 24 outputs a recognition result for a serial number formed from a plurality of characters. For example, when the serial number of banknote BL is formed from six characters to l1 to l6 as illustrated in FIG. 7, the serial number recognition unit 24 outputs, as the serial number recognition result, six characters specified in the processing of Step S229 in sequence as the value of counter n increases from "1" to "6". For example, the serial number recognition unit 24 outputs "BX3970" as the recognition result.

However, the serial number recognition unit 24 outputs those characters determined to be unclear as described earlier by substituting same with "?". For example, when "9" in serial number "BX3970" is determined to be unclear, the serial number recognition unit 24 outputs "BX3?70" as the recognition result.

As described earlier, in the first embodiment, the banknote inspection device 14 has a storage unit 23 and a serial number recognition unit 24. The storage unit 23 stores a first learning model generated using images of characters with holes as training data and a second learning model generated using images of characters without holes as training data. The serial number recognition unit 24 uses the first learning model to recognize a character forming the serial number of banknote BL when the character image has holes, but uses the second learning model to recognize a character forming the serial number of banknote BL when the character image does not have holes.

Because character recognition is performed in this way by using the learning models according to the features of the characters forming the serial number of banknote BL, the accuracy of seral number recognition can be improved.

Furthermore, according to the first embodiment, the serial number recognition unit 24 corrects the contrast of the character presence region image and, based on the contrast-corrected character presence region image, uses the first learning model or second learning model to recognize the characters forming the serial number.

Thus, because the ratio of the grayscale values of character portions in the character presence region image to the grayscale values of background portions therein is large, the accuracy of serial number recognition can be further improved.

Furthermore, according to the first embodiment, the serial number recognition unit 24 uses first binarization to binarize a banknote image, and uses the binarized banknote image to specify a character presence region in the banknote image. On the other hand, the serial number recognition unit 24 uses second binarization to binarize a character presence region image, and uses the binarized character presence region image to detect the quantity of holes in a character image. Although a higher computational complexity is involved in the binarization of the second binarization, same preferably has a higher binarization accuracy than the first binarization. For example, the serial number recognition unit 24 uses the binarization illustrated in processing example 1 or processing example 2 above for the first binarization, and uses Otsu's binarization for the second binarization.

Accordingly, first binarization of a low computational complexity can be applied to a banknote image formed from a large quantity of pixels, and highly accurate second binarization can be applied to a character presence region image formed from fewer pixels than the banknote image, and hence, overall, binarization that suppresses computational complexity while satisfying the requisite level of accuracy can be performed.

Moreover, according to the first embodiment, the serial number recognition unit 24 detects a plurality of candidates for the character presence region in banknote image BLP and specifies the character presence region on the basis of the plurality of detected candidates. For example, the serial number recognition unit 24 specifies the character presence region according to any one or a plurality of the foregoing specific examples 1 to 10.

Thus, the accuracy with which a character presence region is specified can be improved.

Second Embodiment

<Hardware Configurations of Banknote Inspection Device>

The banknote inspection device 14 can be realized by means of the following hardware configurations. The banknote photographing unit 21 is realized by a camera, for example. The denomination discrimination unit 22 is realized by various sensors such as an optical sensor and a magnetic sensor, for example. The serial number recognition unit 24 is realized by a processor, for example. The storage unit 23 is realized by memory, for example. Possible examples of a processor include a central processing unit (CPU), a digital signal processor (DSP), and a field programmable gate array (FPGA). Possible examples of memory include random access memory (RAM) such as synchronous dynamic random-access memory (SDRAM), read-only memory (ROM), and flash memory.

Furthermore, the respective processing in the foregoing description by the serial number recognition unit 24 may be implemented by causing a processor to execute programs corresponding to the respective processing. For example, the programs corresponding to the respective processing in the foregoing description by the serial number recognition unit 24 may be stored in the memory of the banknote handling device 1, and the programs may be read and executed by the processor of the banknote handling device 1. In addition, the programs may be stored on a program server, which is connected to the banknote handling device 1 via an optional network, and downloaded to the banknote handling device 1 from the program server and executed, or may be stored on a recording medium which can be read by the banknote handling device 1 and read from the recording medium and executed. Recording media which can be read by the banknote handling device 1 include, for example, portable storage media such as a memory card, USB memory, an SD card, a flexible disk, a magneto-optical disk, a CD-ROM, a DVD, and a Blu-ray (registered trademark) disk. Furthermore, programs are data processing methods described using an optional language or an optional descriptive method, and are in a source code and binary code-agnostic format. Moreover, the programs are not necessarily limited to being constituted as single units and may include programs which are configured distributed as a plurality of modules or a plurality of libraries, and programs that collaborate with another program represented by an operating system (OS) so as to achieve the functions thereof.

According to the disclosed embodiments, it is possible to improve the accuracy with which a serial number of a banknote is recognized.

Although the present disclosure has been described with respect to specific embodiments for a complete and clear disclosure, the appended claims are not to be thus limited hut are to be construed as embodying all modifications and alternative constructions that may occur to one skilled in the art that fairly fall within the basic teaching herein set forth.

What is claimed is:

1. A banknote inspection device, comprising:

a storage unit configured to store a first learning model generated using an image of a character with a hole as training data, and a second learning model generated using an image of a character without a hole as training data; and a recognition unit configured to recognize a serial number character that is a character forming a serial number of a banknote by using the first learning model when a character image, which is an image of the serial number character, has a hole, and recognize the serial number character by using the second learning model when the character image does not have a hole.

2. The banknote inspection device according to claim 1, wherein the recognition unit corrects contrast of a region image, which is an image of a region in which the character image is present, and, on the basis of the contrast-corrected region image, uses the first learning model or the second learning model to recognize the serial number character.

3. The banknote inspection device according to claim 1, wherein the recognition unit uses first binarization to binarize a banknote image, which is an image of the banknote, and uses the binarized banknote image to specify a presence region, which is a region where the character image is present in the banknote image, uses second binarization different from the first binarization to binarize a region image, which is an image of the presence region, and uses the binarized region image to inspect the quantity of holes in the character image.

4. The banknote inspection device according to claim 3, wherein the banknote image includes a plurality of pixels, and in the first binarization, the recognition unit configures a first portion and a second portion among the plurality of pixels, uses the pixel of the first portion to calculate a threshold value for the first binarization, and binarizes the pixel of the second portion according to the calculated threshold value.

5. The banknote inspection device according to claim 3, wherein the recognition unit uses Otsu's binarization for the second binarization.

6. The banknote inspection device according to claim 1, wherein the recognition unit detects a plurality of candidates for a presence region, which is a region where the character image is present in a banknote image which is an image of the banknote, and specifies the presence region on the basis of the detected plurality of candidates.

7. The banknote inspection device according to claim 6, wherein the recognition unit excludes, from the plurality of candidates, a candidate for which the size of the presence region is less than a predetermined size.

8. The banknote inspection device according to claim 6, wherein the recognition unit excludes, from the plurality of candidates, a candidate for which the size of the presence region is equal to or greater than a predetermined size.

9. The banknote inspection device according to claim 6, wherein the recognition unit excludes, from the plurality of candidates, a candidate for which the proportion of black pixels relative to white pixels in the presence region is equal to or greater than a predetermined value.

10. The banknote inspection device according to claim 6, wherein the recognition unit excludes, from the plurality of candidates, a candidate for which the quantity of black pixels distributed in the presence region is equal to or greater than a predetermined value.

11. The banknote inspection device according to claim 6, wherein the recognition unit excludes, from the plurality of candidates, a candidate which is within a predetermined distance from edges of a rectangular region in which a successive plurality of the character images is present.

12. The banknote inspection device according to claim 6, wherein the recognition unit excludes, from the plurality of candidates, a candidate for which a distance from the other candidates is equal to or greater than a predetermined value.

13. The banknote inspection device according to claim 6, wherein for each candidate of the plurality of candidates, when a shortest distance between two outlines in the presence region is less than a predetermined value, the recognition unit integrates the two outlines.

14. The banknote inspection device according to claim 6, wherein, when the quantity of the plurality of candidates is smaller than the quantity of the serial number of the banknote, the recognition unit adds a new candidate for the presence region to the plurality of candidates on the basis of the quantity of the serial number.

15. A banknote inspection method, comprising:

recognizing a serial number character that is a character forming a serial number of a banknote by using a first learning model when a character image, which is an image of the serial number character, has a hole; and recognizing the serial number character by using a second learning model when the character image does not have a hole, the first learning model being generated using an image of a character with a hole as training data, the second learning model being generated using an image of a character without a hole as training data.

16. A non-transitory recording medium storing a banknote inspection program product for causing a processor to execute processing to:

recognize a serial number character that is a character forming a serial number of a banknote by using a first learning model when a character image, which is an image of the serial number character, has a hole; and recognize the serial number character by using a second learning model when the character image does not have a hole, the first learning model being generated using an image of a character with a hole as training data, the second learning model being generated using an image of a character without a hole as training data.

* * * * *